US009927761B2

(12) United States Patent
Ueno et al.

(10) Patent No.: US 9,927,761 B2
(45) Date of Patent: Mar. 27, 2018

(54) IMAGE FORMING APPARATUS

(71) Applicant: CANON KABUSHIKI KAISHA, Tokyo (JP)

(72) Inventors: Takashi Ueno, Tokyo (JP); Masahiro Makino, Tsukubamirai (JP); Ryuta Ai, Tokyo (JP); Yuichi Hatanaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/416,483

(22) Filed: Jan. 26, 2017

(65) Prior Publication Data

US 2017/0227914 A1 Aug. 10, 2017

(30) Foreign Application Priority Data

Feb. 8, 2016 (JP) ..... 2016-022171

(51) Int. Cl.
*G03G 15/00* (2006.01)
*G03G 21/00* (2006.01)

(52) U.S. Cl.
CPC ..... *G03G 21/0011* (2013.01)

(58) Field of Classification Search
CPC ..... G03G 21/0011
See application file for complete search history.

(56) References Cited

U.S. PATENT DOCUMENTS 4,924,270 A * 5/1990 Sako ..... G03G 15/0849 399/63
7,430,378 B2 9/2008 Inami et al.
2005/0180773 A1* 8/2005 Morimoto ..... G03G 15/168 399/101
2013/0195485 A1* 8/2013 Ueno ..... G03G 15/161 399/53

FOREIGN PATENT DOCUMENTS

JP 2004-191737 A 7/2004
JP 2007-328175 A 12/2007
JP 2011-197692 A 10/2011

OTHER PUBLICATIONS

U.S. Appl. No. 15/623,867, Takashi Ueno Masahiro Makino Ryuta Ai Yuichi Hatanaka, filed Jun. 15, 2017.

* cited by examiner

*Primary Examiner* — Ryan Walsh
(74) *Attorney, Agent, or Firm* — Fitzpatrick, Cella, Harper & Scinto

(57) ABSTRACT

An image forming apparatus includes an image bearing member, a transfer member, a cleaning member, and an executing portion configured to execute a supplying operation for forming a predetermined toner image on the image bearing member during non-image formation and then supplying toner of the predetermined toner image to the contact portion. The executing portion executes the supplying operation with a forming condition of the predetermined toner image preset on the basis of information preset on contact pressure applied by the cleaning member to the image bearing member.

19 Claims, 7 Drawing Sheets

IMAGE FORMING APPARATUS

FIELD OF THE INVENTION AND RELATED ART

The present invention relates to an image forming apparatus, such as a copying machine, a printer, a facsimile machine or a multifunction machine having functions of these machines, of an electrophotographic type, or an electrostatic recording type.

In the image forming apparatus of the electrophotographic type or the like, there is a need to remove toner and another deposited matter which remain on a surface of an image bearing member such as a photosensitive member after a toner image is transferred from the image bearing member onto a toner image receiving member. As a cleaning means for that purpose, cleaning devices each including a cleaning member provided in contact with the image bearing member are used. Of these cleaning devices, a cleaning device including a cleaning blade, which is a plate-shaped (blade-shaped) cleaning member, having elasticity has been widely used.

The cleaning blade is contacted to the surface of the image bearing member counter directionally to a movement direction of the surface of the image bearing member in many cases. For that reason, a frictional force between the image bearing member and the cleaning blade is relatively large. Further, when this frictional force is excessively large, a piece of a broken edge of the cleaning generates and turning-up of the edge of the cleaning blade such that the edge of the cleaning blade is turned over with respect to the movement direction of the surface of the image bearing member generates in some cases.

Therefore, there is a method in which a band-shaped toner image (toner band) is formed on the image bearing member and toner of this toner band is supplied to a contact portion between the image bearing member and the cleaning blade (Japanese Laid-Open Patent Application (JP-A) 2007-328175). The toner of the toner band and an external additive thereof are interposed between the image bearing member and the cleaning blade and are caused to function as a lubricant, so that it is possible to suppress an excessive increase in frictional force between the image bearing member and the cleaning blade. In JP-A 2007-328175, in the case where a detected value of a current of a motor for driving the image bearing member exceeds a predetermined value, the toner band is formed.

However, in the conventional method, a difference in contact pressure (also referred to as "blade pressure") of the cleaning blade against the image bearing member due to a manufacturing variation was not taken into consideration, and therefore it turned out that the following problem generated in some cases.

That is, in the case where the blade pressure is relatively low, the toner of the toner band cannot be completely blocked by the cleaning blade and passes through the cleaning blade, so that toner contamination (improper cleaning) generates in some cases on an image to be formed thereafter. On the other hand, in the case where the blade pressure is relatively high, an amount of the toner of the toner band is insufficient and therefore the toner in the neighborhood of the cleaning blade and the external additive thereof are depleted relatively early, and therefore there is a need to frequently form the toner band in some cases. In the case where the toner band is not formed frequently and the frictional force between the image bearing member and the cleaning blade is excessively large, the piece of the broken cleaning blade and the turning-up of the cleaning blade generate in some cases as described above.

SUMMARY OF THE INVENTION

According to an aspect of the present invention, there is provided an image forming apparatus comprising: an image bearing member configured to bear a toner image; a transfer member configured to transfer the toner image from the image bearing member onto a toner image receiving member at a transfer portion; a cleaning member contacting the image bearing member at a contact portion and configured to remove transfer residual toner remaining on a surface of the image bearing member from the surface of the image bearing member with movement of the image bearing member; and an executing portion configured to execute a supplying operation for forming a predetermined toner image on the image bearing member during non-image formation and then supplying toner of the predetermined toner image to the contact portion, wherein the executing portion executes the supplying operation with a forming condition of the predetermined toner image preset on the basis of information on contact pressure applied by the cleaning member to the image bearing member.

Further features of the present invention will become apparent from the following description of exemplary embodiments with reference to the attached drawings.

DESCRIPTION OF THE EMBODIMENTS

An image forming apparatus according to the present invention will be described with reference to the drawings.

Embodiment 1

1. General Constitution and Operation of Image Forming Apparatus

Figure 1:
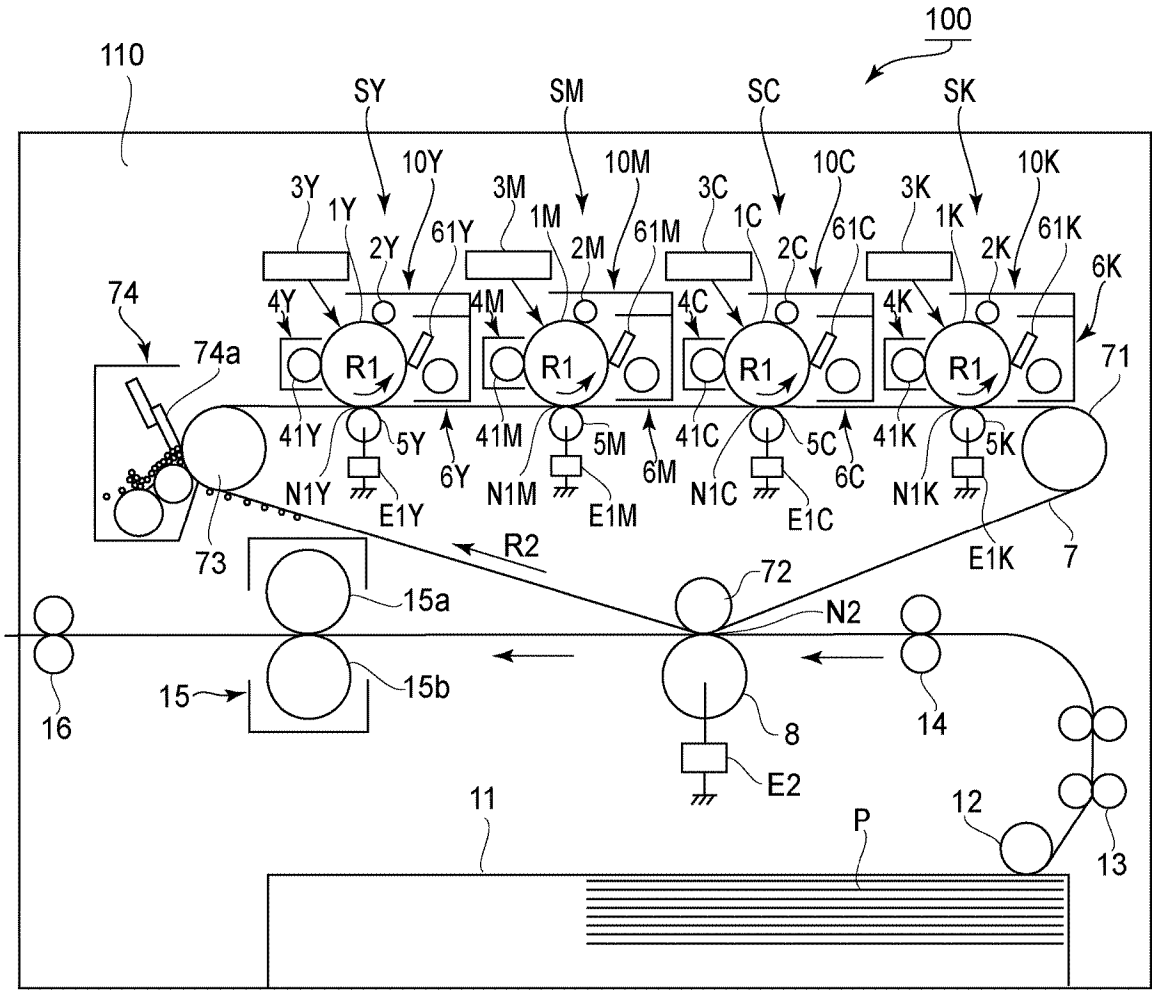
FIG. 1 is a schematic sectional view of an image forming apparatus.

FIG. 1 is a schematic sectional view of an image forming apparatus 100 in this embodiment according to the present invention.

The image forming apparatus 100 in this embodiment is a tandem-type printer employing an intermediary transfer type capable of forming a full-color image.

The image forming apparatus 100 includes, as a plurality of image forming portions (stations), first to fourth image forming portions SY, SM, SC and SK for forming images of yellow (Y), magenta (M), cyan (C) and black (K), respectively. In this embodiment, constitutions and operations of the first to fourth image forming portions SY, SM, SC and SK are substantially the same except that the colors of toners used are different from each other. Accordingly, in the case where particular distinction is not required, suffixes Y, M, C and K for representing elements for associated colors are omitted, and the elements will be collectively described. In this embodiment, the image forming portion S is constituted by a photosensitive drum 1, a charging roller 2, an exposure device 3, a developing device 4, a primary transfer roller 5, a drum cleaning device 6, and the like, which are described later.

At the image forming portion S, the photosensitive drum 1 which is a drum-shaped (cylindrical) photosensitive member (electrophotographic photosensitive member) as a rotatable first image bearing member is provided.

The photosensitive drum 1 is rotationally driven in an indicated arrow R1 direction (counterclockwise direction) at a predetermined peripheral speed (process speed). A surface of the rotating photosensitive drum 1 is electrically charged to a predetermined polarity (negative in this embodiment) and a predetermined potential by the charging roller 2 which is a roller-type charging member as a charging means. During a charging step, to the charging roller 2, a charging voltage (charging bias) which is an oscillating voltage in the form of a negative DC voltage biased with an AC voltage is applied.

The surface of the charged photosensitive drum 1 is exposed to light depending on image information by the exposure device 3 as an exposure means, so that an electrostatic latent image (electrostatic image) is formed on the photosensitive drum 1. In this embodiment, the exposure device 3 is a laser scanner for carrying out scanning exposure with laser light of wavelength $\lambda$=780 nm. The exposure device 3 scans the photosensitive drum surface by a rotating mirror with a laser beam subjected to ON-OFF modulation depending on scanning line image data developed from an image of separated color corresponding to the image forming portion S, and thus writes (forms) the electrostatic latent image on the surface of the charged photosensitive drum 1.

The electrostatic image formed on the photosensitive drum 1 is developed (visualized) by supplying the toner by the developing device 4, so that the toner image is formed on the photosensitive drum 1. In this embodiment, the developing device 4 is a two-component developing device using a two-component developer in which toner (non-magnetic toner particles) as a developer and a carrier (magnetic carrier particles) are mixed with each other. The developing device 4 carries the two-component developer on a developing sleeve 41 as a developer carrying member and feeds the developer to an opposing portion to the photosensitive drum 1, and deposits the toner of the two-component developer on the photosensitive drum 1 depending on the electrostatic latent image, so that the toner image is formed. During a developing step, to the developing sleeve 41, a developing voltage (developing bias) which is an oscillating voltage in the form of a negative DC voltage biased with an AC voltage is applied. As a result, the toner negatively charged to the same polarity as the charge polarity of the photosensitive drum 1 is transferred onto an exposed portion of the photosensitive drum 1 which is lowered in absolute value of the potential by the exposure to light after the photosensitive drum 1 is charged and which has the positive polarity relative to the developing sleeve 41 (reverse development).

An intermediary transfer belt 7 which is an intermediary transfer member constituted by an endless belt as a rotatable second image bearing member is provided opposed to the respective photosensitive drums 1 of the image forming portions S. The intermediary transfer belt 5 is extended around a driving roller 71, a secondary transfer opposite roller 72 and a tension roller 73 which are used as stretching rollers, and is stretched with a predetermined tension. The intermediary transfer belt 7 is rotationally driven by the driving roller 71 in an indicated arrow R2 direction (clockwise direction) at a peripheral speed corresponding to the peripheral speed of the photosensitive drum 1. In an inner peripheral surface side of the intermediary transfer belt 7, the primary transfer roller 5 which is a roller-type primary transfer member as a primary transfer means is provided corresponding to the photosensitive drum 1. The primary transfer roller 5 is pressed (urged) against the intermediary transfer belt 7 toward the photosensitive drum 1, so that a primary transfer portion (primary transfer nip) N1 is formed where the photosensitive drum and the intermediary transfer belt 7 contact each other.

The toner image formed on the photosensitive drum 1 is transferred (primary-transferred) by the action of the primary transfer roller 5 onto the intermediary transfer belt 7 as a toner image receiving member at the primary transfer portion N1. During a transfer step, to the primary transfer roller 5, a primary transfer voltage (primary transfer bias) which is a DC voltage of an opposite polarity to the charge polarity (positive in this embodiment) of the toner during the development is applied from a primary transfer voltage source E1. Incidentally, in this embodiment, the primary transfer voltage source E1 is provided correspondingly to the associated one of the respective image forming portions S, and is constituted so as to be capable of applying a positive(-polarity) voltage and a negative(-polarity) voltage to the primary transfer roller 5 in a switching manner. For example, during full-color image formation, the respective color toner images of yellow, magenta, cyan and black formed on the respective photosensitive drums 1 are successively transferred superposedly onto the intermediary transfer belt 7. Toner (transfer residual toner) and deposited matter such as an external additive which remain on the surface of the photosensitive drum 1 after a primary transfer are removed and collected from the surface of the photosensitive drum 1 by the drum cleaning device 6 as a photosensitive member cleaning means. The drum cleaning device 6 rubs the surface of the photosensitive drum 1 with a cleaning blade 61 as a cleaning member, and collects the toner and the deposited matter on the photosensitive drum 1.

At a position opposing the secondary transfer opposite roller 72 on an outer peripheral surface side of the intermediary transfer belt 7, a secondary transfer roller 8, which is a roller-type secondary transfer member as a secondary transfer means, is provided. The secondary transfer roller 8 is pressed (urged) against the intermediary transfer belt 7 toward the secondary transfer opposite roller 72 and forms a secondary transfer portion (secondary transfer nip) N2 where the intermediary transfer belt 7 and the secondary transfer roller 8 are in contact with each other.

The toner images formed on the intermediary transfer belt 7 as described above are transferred (secondary-transferred) by the action of the secondary transfer roller 8 onto the recording material P, such as paper as a toner image receiving member, nipped and fed at the secondary transfer portion N2 by the intermediary transfer belt 7 and the secondary transfer roller 8. During a secondary transfer step, to the secondary transfer roller 8, a secondary transfer voltage (secondary transfer bias) which is a DC voltage of an opposite polarity to the normal charge polarity of the toner is applied from a secondary transfer voltage source E2. The recording material P is accommodated in a recording material cassette 11 and is pulled out from the recording material cassette 11 by a pick-up roller 12, and then is separated one by one by a separation roller 13, so that the recording material P is fed to a registration roller pair 14. Then, the recording material P fed to the secondary transfer portion N2 while being timed to the toner images on the intermediary transfer belt 7 by the registration roller pair 14.

The recording material P on which the toner images are transferred is fed to a fixing device 15 as a fixing means and is heated and pressed at a nip between a heating roller 15*a* and a pressing roller 15*b* which constitute the fixing device 15, so that the toner images are fixed (melt-fixed) on the surface of the recording material P. The recording material P on which the toner images are fixed is discharged to an outside of the apparatus main assembly 110 of the image forming apparatus 100 by a discharging roller pair 16.

Further, toner (transfer residual toner) and deposited matter such as an external additive, which remain on the surface of the intermediary transfer belt 7 after a secondary transfer step, are removed and collected from the surface of the intermediary transfer belt 7 by a belt cleaning device 74 as an intermediary transfer member cleaning means. The belt cleaning device 74 rubs the surface of the intermediary transfer belt 7 with a cleaning blade 74*a* which is a cleaning member, and collects the deposited matter on the intermediary transfer belt 7.

In this embodiment, at each of the image forming portions S, the photosensitive drum 1, the charging roller 2 and the drum cleaning device 6 integrally constitute a drum cartridge 10 detachably mountable to the apparatus main assembly 110. Further, at each image forming portion S, the developing device 4 constitutes a developing cartridge detachably mountable to the apparatus main assembly 110.

Further, in this embodiment, operations of the respective portions of the image forming apparatus 100 are controlled by a controller 30 (FIG. 5) as a control means provided in the apparatus main assembly 110 of the image forming apparatus 100. The controller 30 includes a computation controller (CPU), storing portions (ROM, RAM) and the like, and effects integrated control of the operations of the respective portions of the image forming apparatus 100 in accordance with programs and data stored in the storing portions thereof.

Here, the image forming apparatus 100 performs a series of image outputting operations (job, print operation) which is started by a start instruction (command) and in which an image is formed on a single or a plurality of recording materials P and then the recording materials P are outputted. The job generally includes an image forming step, a pre-rotation step, a sheet interval step in the case where the image is formed on the plurality of the recording materials P, and a post-rotation step. The image forming step is a period in which formation of the electrostatic latent image for an image formed and outputted on the recording material P, formation of the toner image, and primary transfer and secondary transfer of the toner image are actually performed, and "during image formation" refers to this period. Specifically, at each of positions where steps of effecting the formation of the electrostatic latent image, the formation of the toner image, and the primary transfer and the secondary transfer of the toner image, timing during image formation is different. The pre-rotation step is a period in which a preparatory operation, from input of the start instruction until the image formation is actually started, before the image forming step is performed. The sheet interval step is a period corresponding to an interval between a recording material P and a subsequent recording material P when the image formation is continuously performed (continuous image formation) with respect to the plurality of recording materials P. The post-rotation step is a period in which a post-operation (preparatory operation) after the image forming step is performed. "During non-image formation" refers to a period other than "during image formation", and includes the pre-rotation step, the sheet interval step, the post-rotation step and further includes a pre-multi-rotation step which is a preparatory operation during main switch actuation of the image forming apparatus 100 or during restoration from a sleep state. An operation for supplying the toner to a contact portion between the photosensitive drum 1 and the cleaning blade 61 (described later) is executed during non-image formation.

2. Photosensitive Drum

Figure 2:
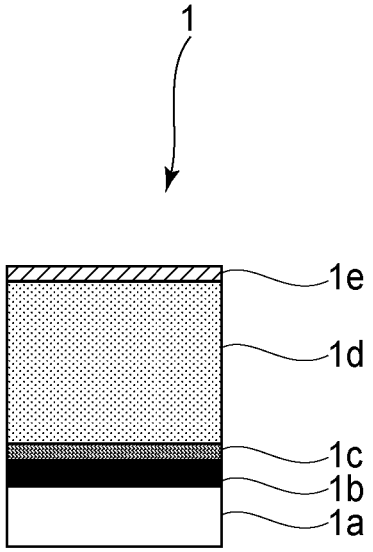
FIG. 2 is a sectional view showing a layer structure of a photosensitive drum.

FIG. 2 is a sectional view showing a layer structure of the photosensitive drum 1. In this embodiment, the photosensitive drum 1 includes a lamination-type OPC photosensitive layer in which an electroconductive substrate (supporting member) 1*a* having electroconductivity, a charge-generating layer 1*c* and a charge-transporting layer 1*d* are successively laminated. In this embodiment, the electroconductive substrate 1*a* is an aluminum cylinder. Further, in this embodiment, on the surface of the electroconductive substrate 1*a*, an undercoat layer 1*b* having a barrier function and an adhesive function is provided. The undercoat layer 1*b* is formed for the purpose of improvement of an adhesive property of the photosensitive layer, improvement of a coating property, protection of the electroconductive substrate 1*a*, coating of unevenness on the electroconductive substrate 1*a*, improvement of a charge injection property from the electroconductive substrate 1*a*, protection of the photosensitive layer against electrical breakdown, and the like. Further, in this embodiment, a surface protection layer 1*d* is formed on the photosensitive layer of a function separation type in which the charge-generating layer 1*c* and the charge-transporting layer 1*d* are successively laminated.

In this embodiment, the surface of the photosensitive drum 1 is abraded by an abrading tape (lapping paper), buffing or the like, so that a ten-point average roughness Rz (JIS B0601-1982) is 0.2-2 μm.

3. Developer

In this embodiment, the developer (two-component developer) in which the carrier and the toner were mixed in a weight ratio of 91:9 (toner content: 9%) was used. Further, a total weight of an initial developer accommodated in the developing device 4 was 350 g.

As the carrier, ferrite particles coated with a silicone resin material were used. This carrier is 24 ($Am^2/kg$) in saturation magnetization under application of a magnetic field of 240 (kA/m), $1\times10^7$ (Ω.cm)–$1\times10^8$ (Ω.cm) in resistivity at electric field intensity of 3000 (V/cm) and 50 μm in weight-average particle size.

The toner is constituted by containing at least a binder, a colorant and a charge control agent. In this embodiment, as a binder resin material, a styrene-acrylic resin material was used. However, it is also possible to use resin materials of styrenes, polyesters, polyethylene and the like. As the colorant, various pigments, dyes and the like may be used singly or in combination of a plurality of kinds. The charge control agent may also contain a charge controlling agent for assisting the charge control agent as desired. As the charge controlling agent for assisting the charge control agent, it is possible to use a nigrosine-based dye, a triphenylene-based dye, and the like. The weight-average particle size of the toner is 5.7 μm.

Further, the toner contains a wax. The wax is contained for improving a parting property from a fixing member and improving a fixing property during fixation. As the wax, a paraffin wax, carnauba wax, polyolefin or the like can be used, and is used in a state in which the wax is kneaded and dispersed in the binder resin material. In this embodiment, as the toner, toner obtained by pulverizing a resin material, obtained by kneading and dispersing the binder, the colorant, the charge control agent and the wax, by a mechanical pulverizer was used.

Further, into the toner, an external additive is added (externally added). As the external additive, fine particles of amorphous silica subjected to hydrophobization or fine particles of inorganic oxides such as titanium oxide and a titanium compound may be used. These fine particles are added to the toner, so that it is possible to adjust powder flowability and a charge amount of the toner. A particle size of the external additive may preferably be 1 nm or more and 100 nm or less. In this embodiment, titanium oxide fine particles of 50 nm in average particle size were added in a weight ratio of 0.5 wt. % with respect to the toner base material, and amorphous silica fine particles of 2 nm in average particle size and amorphous silica fine particles of 100 nm in average particle size were added in weight ratios of 0.5 wt. % and 1.0 wt. %, respectively, with respect to the toner base material.

In the developing device 4, when the developer is stirred, the toner is charged to the negative polarity, and the carrier is charged to the positive polarity. The charged developer rubs the photosensitive drum 1 in a state in which the developer is carried and erected on the developing sleeve 41 in which a magnet member is fixedly provided at a hollow portion.

4. Drum Cleaning Device

Figure 3:
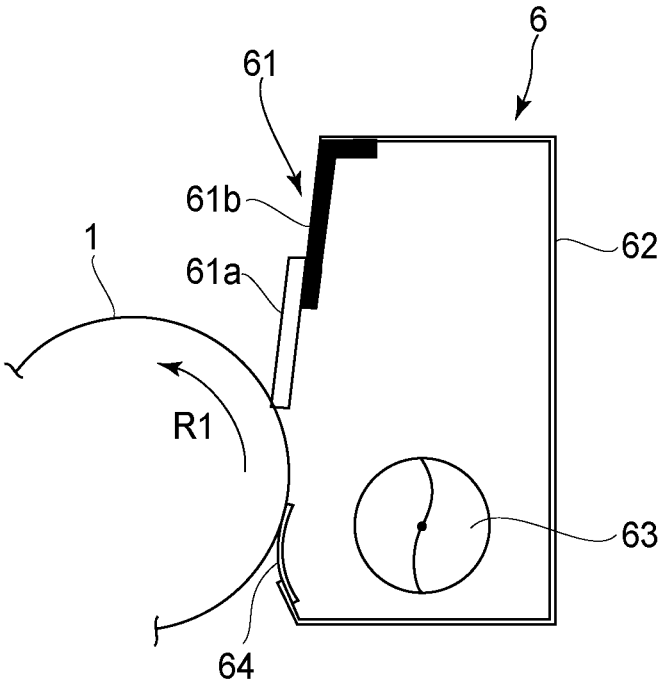
FIG. 3 is a sectional view of a drum cleaning device.

FIG. 3 is a sectional view showing the drum cleaning device 6 together with the photosensitive drum 1 in this embodiment. In this embodiment, the cleaning blade 61 is constituted by a supporting portion 61*b* formed with a metal plate and a rubber portion 61*a* formed of a rubber material having proper elasticity and hardness.

In this embodiment, as a material of the rubber portion 61*a*, polyurethane (urethane rubber) was employed since the polyurethane did not damage the photosensitive drum 1 and was large in anti-wearing property. When small permanent strain is taken into consideration, a two-part curable polyurethane may also be employed. It is also possible to employ, other than the polyurethane, a styrene-butadiene copolymer, chloroprene, butadiene rubber, ethylene-propylene-diene-based rubber, chlorosulfonated polyethylene rubber, fluorine-containing rubber, silicone rubber, and the like.

In this embodiment, the rubber portion 61*a* is formed by molding in a size of 340 mm in longitudinal length, 15 mm in widthwise length and 2 mm in thickness, and a length (free length) of a portion, with respect to the widthwise direction, which is not supported by the supporting portion 61*b* is 8 mm. The cleaning blade 61 is disposed so that a longitudinal direction of the rubber portion 61*a* is substantially parallel to a longitudinal direction (rotational axis direction) of the photosensitive drum 1. Further, a longitudinal length of the rubber portion 61*a* is longer than an image forming region (region where the toner image is formable) with respect to the longitudinal direction of the photosensitive drum 1, so that the image forming region falls within the longitudinal length of the rubber portion 61*a*.

The cleaning blade 61 is contacted to the photosensitive drum 1 at an edge portion of the rubber portion 61*a* so that a free end of the rubber portion 61*a* faces toward an upstream side of the rotational direction of the photosensitive drum 1. Particularly, in this embodiment, a constitution in which the cleaning blade 61 is disposed downwardly and rubs a surface-to-be-cleaned of the photosensitive drum 1 which moves upwardly and thus cleaning power is relatively high is employed. The cleaning blade 61 is mounted to a housing 62 in a state in which the cleaning blade 61 is urged so as to provide a predetermined entering amount into the photosensitive drum 1.

A lower portion in the housing 62 is an accommodating portion for accommodating the transfer residual toner and the like collected from the surface of the photosensitive drum 1 by the cleaning blade 61, and at this accommodating portion, a feeding screw 63 as a feeding means is provided. The feeding screw 63 feeds the transfer residual toner and the like, collected in the housing 62, toward one end side of the cleaning device 6 with respect to the longitudinal direction, so that the transfer residual toner and the like are collected in an external collecting container (not shown) of the cleaning device 6. Further, at a lower edge portion of the housing 62 at a position opposing the photosensitive drum 1, a scattering preventing sheet 64 for suppressing scattering of the transfer residual toner and the like from an inside to an outside of the housing 62 is provided. In this embodiment, the scattering preventing sheet 64 is formed of a sheet material of polyethylene terephthalate resin and having a thickness of 20 μm-50 μm, and a free end in a free-end side thereof is provided in contact with the photosensitive drum 1.

5. Measurement of Blade Pressure

The contact pressure (blade pressure) of the cleaning blade 61 against the photosensitive drum 1 can be measured by using a load cell (load sensor). The present invention is not limited thereto, but in this embodiment, the blade pressure was measured in the following manner.

A blade pressure measuring device (jig) is constituted by including the photosensitive drum 1, the cleaning blade 61, a supporting member for supporting these members, and the load cell for measuring a load exerted on the photosensitive drum 1. The supporting member of the cleaning blade 61 is movable relative to the photosensitive drum 1 and is capable of changing an entering (penetration) amount of the cleaning blade 1 into the photosensitive drum 1. The entering amount of the cleaning blade 61 is an amount in which the cleaning blade 61 is contacted to the photosensitive drum 1 and thereafter is further pressed against the photosensitive drum 1 toward an inside of the photosensitive drum 1 with respect to a radial direction of the photosensitive drum 1. This entering amount is represented by a distance, with respect to the radial direction of the photosensitive drum 1, between a tangential line at the contact portion of the photosensitive drum 1 and the cleaning blade 61 and the free end on the assumption that the cleaning blade 61 is not deformed. When the blade pressure is measured, the cleaning blade 61 is contacted to the load sensor, and the load sensor is pressed in an entering amount of the cleaning blade 61 used in an actual machine (product). An output value of the load sensor at that time is amplified by an amplifier and is read by a volt meter. Then, the blade pressure is calculated from a load per unit voltage obtained in advance.

In this embodiment, the blade pressure of the cleaning blade 61 in an entire longitudinal region is measured by a single load sensor. However, the longitudinal region is divided into a plurality of sections and loads are measured by a plurality of load sensors provided correspondingly to the respective sections, and the sum of the measured loads may also be used as the blade pressure. Or, as the blade pressure, an average of the loads measured by the plurality of load sensors or a representation value such as a maximum or a minimum may also be used. Further, in this embodiment, blade pressure per unit longitudinal length (line pressure) (g/cm), of the cleaning blade 61, obtained by dividing the value of the load (g) measured by the load cell by a longitudinal length (cm) of the cleaning blade 61 is used. However, the value of the load (g) measured by the load cell may also be used as it is.

As regards the blade pressure to be measured, a variation generates, for example, every individual cleaning device 6 or every production lot of the cleaning device 6. This variation in blade pressure generates due to a manufacturing variation of the cleaning blade 61 alone in some cases. For example, the variation in blade pressure generates due to a thickness, a dimension of a free length, rubber hardness of the rubber portion 61*a* of the cleaning blade 61, an extrusion amount, a thickness or the like of an adhesive when the rubber portion 61*a* is bonded to the supporting portion 61*b*. Further, this variation blade pressure also generates due to a manufacturing variation of the cleaning device 6 in some cases. For example, the variation in blade pressure generates due to a variation depending on mechanical accuracy of the spring, the metal plate and the like constituting the cleaning device 6. For this reason, there is a tendency that the variation in blade pressure is larger with an increasing number of parts constituting the cleaning device 6.

The measurement of the blade pressure can be carried out every unit for which there is a possibility of generation of the variation in blade pressure having the influence on a degree of generation of improper cleaning, a piece of broken cleaning blade, turning-up of the cleaning which are described later. For example, the blade pressure measurement can be carried out every individual cleaning blade 61 (drum cartridge 10), every production lot of the cleaning blade 61 (drum cartridge 10), or the like. In this embodiment, the blade pressure measurement is carried out every production lot of the drum cartridge 10 by using a representative constituent part of the drum cartridge 10. In the case where the representative constituent part is used, blade pressure measured using a pair of constituent parts may be used or blade pressure measured using a plurality of pairs of constituent parts may also be used.

6. Storing Portion

Figure 4:
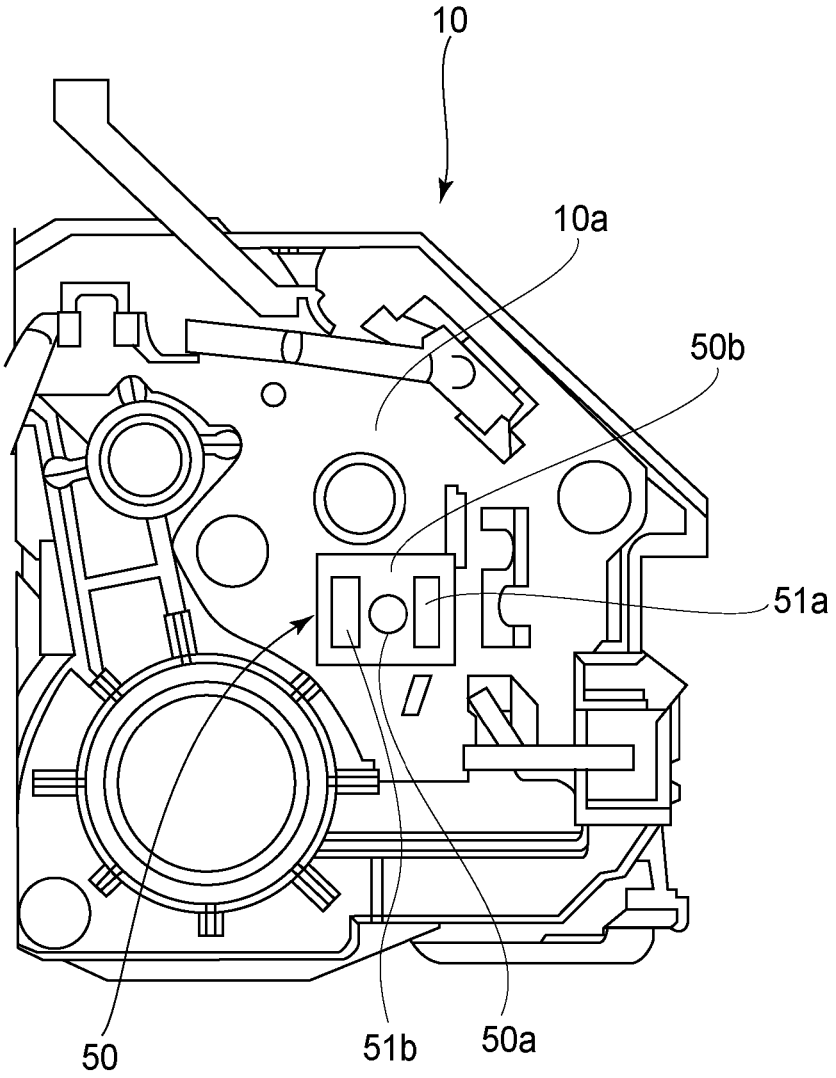
FIG. 4 is a side view of a drum cartridge.

FIG. 4 is a side view showing a side surface of the drum cartridge 10 at one longitudinal end portion in this embodiment. In this embodiment, a side cover 10*a* of the drum cartridge 10 is provided with a cartridge storing portion (tag) 50 as an information storing means. In this embodiment, the cartridge storing portion 50 includes a memory chip 50*a* which is a storing element such as RAM and ROM, and contact portions 51*a*, 51*b* on a substrate 50*b*. The substrate 50*b* is provided with a circuit for reading information from and writing the information in the memory chip 50*a* through the contact portions 51*a*, 51*b*. The memory chip 50*a* is disposed at a substantially central portion of the cartridge storing portion 50 and has a constitution in which a storing element is protected by a resin coating layer (protective portion). The contact portions 51*a*, 51*b* are communicatably connected with main assembly contact portions (not shown) provided in the apparatus main assembly 110 side in order to read the information from the memory chip 50*a* and write the information in the memory chip 50*a*. In this embodiment, the contact portions 51*a*, 51*b* are two gold-plated phosphor bronze plates mounted on the substrate 50*b*. Further, the contact portions 51*a*, 51*b* are substantially flush with the memory chip 50*a* and are disposed in both sides of the memory chip 50*a*. The main assembly contact portions are connected with the controller (control substrate) 30 (FIG. 5) provided in the apparatus main assembly 110. The controller 30 is capable of reading the information from the memory chip 50*a* of the cartridge storing portion 50 and writing the information in the memory chip 50*a* through the main assembly contact portions and the contact portions 51*a*, 51*b* of the cartridge storing portion 50.

By inputting necessary information in the memory chip 50*a* in advance, when the drum cartridge 10 is mounted in the apparatus main assembly 110, exchange of information between the drum cartridge 10 and the controller 30 of the apparatus main assembly 110 is carried out, so that it is possible to send the necessary information to the controller 30. Into the memory chip 50*a*, information can be inputted by a predetermined jig or the like during manufacturing, factory shipment and the like of the drum cartridge 10.

In this embodiment, in the memory chip 50*a*, information on at least the blade pressure is stored. In the cartridge storing portion 50, information, other than the information on the blade pressure, such as lot numbers of the drum cartridge 10 and the cleaning blade 61, individual identification information of the drum cartridge 10, and the like is stored.

Further, even during use of the drum cartridge 10, as desired, it is possible to carry out writing of the information in the cartridge storing portion 50 at any time.

7. Formation of Toner Band

Then, an operation for supplying the toner to the contact portion between the photosensitive drum 1 and the cleaning blade 61 in this embodiment will be described. In this embodiment, a single image forming portion S will be described as a representative, but a similar operation is performed with respect to all of the image forming portions in this embodiment.

In the image forming apparatus 100 in this embodiment, at predetermined timing, during non-image formation (e.g., during the sheet interval step or during the post-rotation step), a supplying operation in which a predetermined toner image is formed on the photosensitive drum 1 and the toner thereof is supplied to the contact portion between the photosensitive drum 1 and the cleaning blade 61 is executed.

In this embodiment, the supplying operation is executed every output of images of a predetermined number (e.g., 100) as the above-described predetermined timing. That is, in this embodiment, the controller 30 functions as an image output number counting means and integrates and stores an image output number every output of the image. Then, the controller 30 executes the supplying operation every time when the image output number reaches a predetermined value, and resets an integrated value of the image output number to 0 every execution of the supplying operation. This cycle is repeated.

Figure 6:
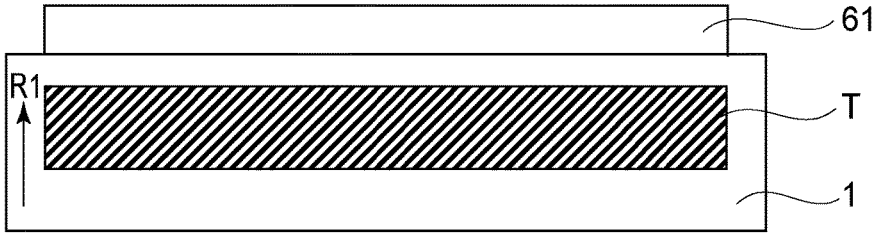
FIG. 6 is a schematic view of a toner band.

Further, in this embodiment, as the predetermined toner image, a band-shaped toner image (toner band) T as shown in FIG. 6 is formed on the photosensitive drum 1. This toner band T has a length extending over an entire image forming region with respect to the longitudinal direction (rotational axis direction) of the photosensitive drum 1, and has a predetermined length (e.g., about 1 cm-10 cm) with respect to a circumferential direction (surface movement direction) of the photosensitive drum 1.

Further, in this embodiment, when the toner band passes through the primary transfer portion N1, in order to suppress transfer of the toner band onto the intermediary transfer belt 7, a voltage of the positive polarity which is the same polarity as the normal charge polarity of the toner (which is the opposite polarity to that during the primary transfer) is applied to the primary transfer roller 5. Incidentally, the toner band can be formed by a process similar to that in the case where the above-described normal image is formed.

The toner band is fed by rotation of the photosensitive drum 1 and reaches the contact portion between the photosensitive drum 1 and the cleaning blade 61. Then, the toner of the toner band and an external additive thereof exist between the photosensitive drum 1 and the cleaning blade 61 and function as a lubricant, so that it is possible to suppress an excessive increase in frictional force between the photosensitive drum 1 and the cleaning blade 61.

However, as described above, by a difference in blade pressure due to the manufacturing variation or the like, a problem due to the toner band generates in some cases. That is, in the case where the blade pressure is relatively low, the toner of the toner band cannot be completely blocked by the cleaning blade 61, so that contamination of the image with the toner (improper cleaning) generates in some cases. Further, in the case where the blade pressure is relatively high, at a relatively early period after the toner image is formed, the piece of the broken cleaning blade 61 and the turning-up of the cleaning blade 61 are liable to generate in some cases.

Figure 7:
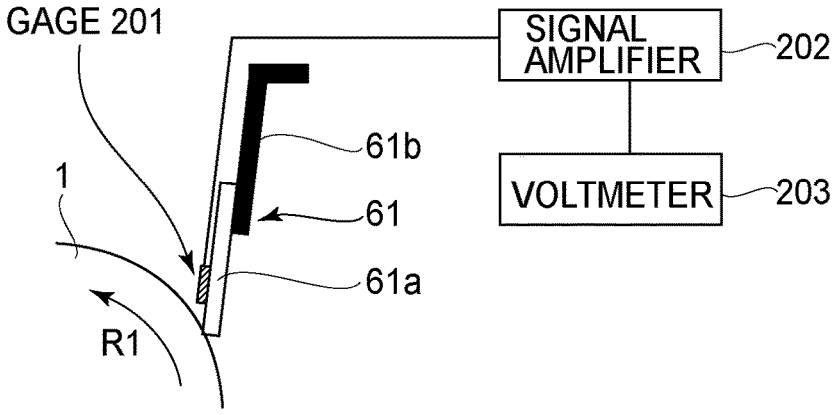
FIG. 7 is a schematic view for illustrating a measuring method of strain of a cleaning blade.

FIG. 7 is a schematic view for illustrating a method of measuring strain (deformation) of the cleaning blade 61. A strain measuring gage 201 (for example, manufactured by Kyowa Electronic Instruments Co., Ltd.) is bonded to a side surface (back surface) extending in the longitudinal direction of the rubber portion 61*a* in a side downstream of the contact portion between the photosensitive drum 1 and the cleaning blade 61 with respect to the rotational direction of the photosensitive drum 1. A measurement result of the strain measuring gage 201 is sent as a voltage to a voltmeter 203 through a signal amplifier 202.

Figure 8:
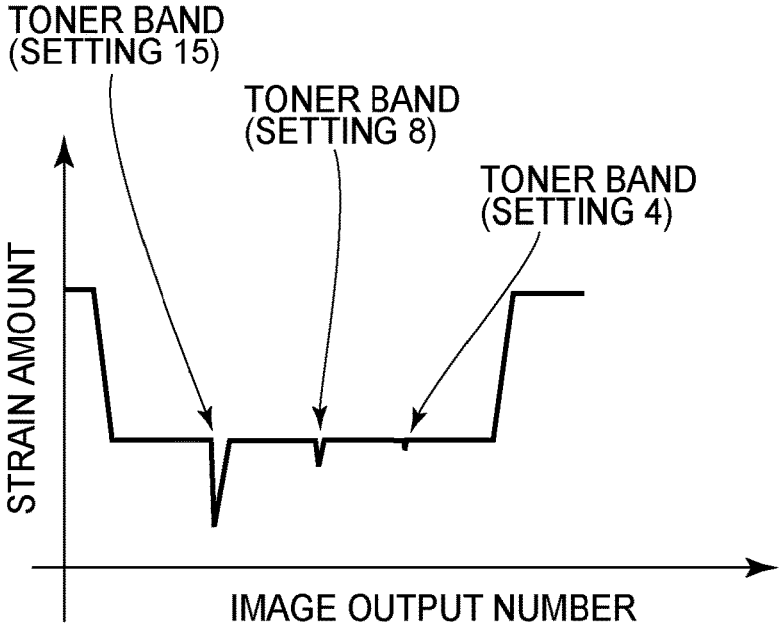
FIG. 8 is a graph showing a difference in strain of the cleaning blade depending on a density of the toner band.

FIG. 8 shows a result of measurement of the strain of the cleaning blade 61 when the toner band is formed every output of the image on 100 sheet sheets while changing a density (toner amount per unit area) (mg/cm$^2$) thereof. As regards the density of the toner band, a density setting "15" is the highest density, and the toner band density becomes lower with a decreasing value of "14", "13", "12", . . . , "2","1", and at a setting value "0", the toner band is not formed. Incidentally, in this embodiment, the toner band with any setting value is a half-tone image, but may also be a solid image. Further, in this embodiment, the toner band density is changed by controlling an electrostatic latent image for the toner band.

As shown in FIG. 8, when the toner band density is changed, a strain amount of the cleaning blade 61 when the toner band reaches the contact portion between the photosensitive drum 1 and the cleaning blade 61 changes. In the case of the toner band with a relatively low density (e.g., density setting 4), there is substantially no strain of the cleaning blade 61. However, in the case of the toner band with a relatively high density (e.g., density setting 15), the strain of the cleaning blade 61 is large. Thus, the strain amount of the cleaning blade 61 when the toner band reaches the contact portion between the photosensitive drum 1 and the cleaning blade 61 is different depending on the toner band density, and there is a tendency that the strain of the cleaning blade 61 is larger with an increasing toner band density.

This is because the load on the cleaning blade 61 is increased by the increase in toner amount per unit area of the toner and thus the cleaning blade 61 is pushed up along a movement (advancing) direction of the photosensitive drum 1. For that reason, in the case where the blade pressure is relatively low, the cleaning blade 61 cannot withstand this load, so that the toner of the toner band passes through the cleaning blade 61 and improper cleaning generates. On the other hand, when the toner amount per unit area of the toner band decreases, the load on the cleaning blade 61 by the toner decreases, so that the cleaning blade 61 is not pushed up and therefore the cleaning blade 61 is not substantially strained (deformed). For that reason, even in the case where the blade pressure is relatively low, the improper cleaning does not generate.

Figure 9:
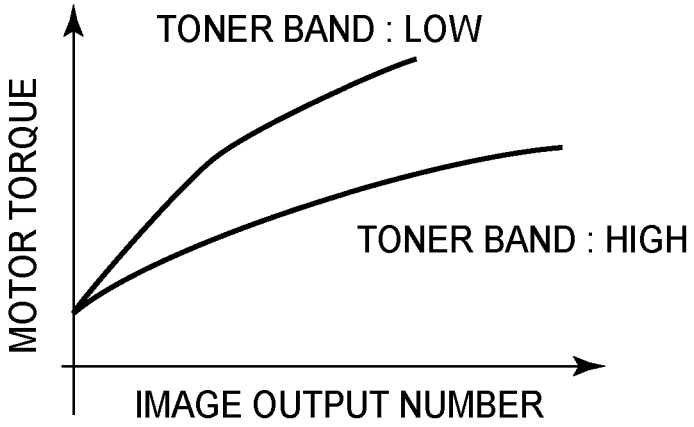
FIG. 9 is a graph showing a difference in driving torque of the photosensitive drum depending on the density of the toner band.

FIG. 9 shows a result of measurement of a torque of a driving motor for the photosensitive drum 1 when solid white images are continuously outputted after the toner bands are formed while changing the toner band density in the image forming apparatus 100 having the constitution in this embodiment. Incidentally, the torque of the driving motor can be measured by obtaining a relationship between a driving current and the torque of the driving motor in advance and then by detecting the driving current of the driving motor.

As shown in FIG. 9, when the toner band density is changed, a torque increasing speed of the driving motor for the photosensitive drum 1 after the toner band is formed changes. In the case of the toner band with a relatively low density (e.g., density setting 4), the torque increasing speed of the driving motor for the photosensitive drum 1 is large (i.e., the torque abruptly increases). However, in the case of the toner band with a relatively high density (e.g., density setting 15), the torque increasing speed of the driving motor for the photosensitive drum 1 is small (i.e., the torque gently increases). Thus, the torque increasing speed of the driving motor for the photosensitive drum 1 is different depending on the toner band density, and there is a tendency that the torque increasing speed of the driving motor is larger with a decreasing toner band density.

This is because when the toner amount per unit area of the toner band decreases, the amount of the toner existing in the neighborhood of the cleaning blade 61 becomes small and thereafter the toner and its external additive which are the lubricant are depleted early and thus a frictional force between the cleaning blade 61 and the photosensitive drum 1 increases. For that reason, in the case where the blade pressure is relatively high, the piece of the broken cleaning blade and the turning-up of the cleaning blade 61 are liable to generate relatively early after the formation of the toner band. On the other hand, when the toner amount per unit area of the toner band increases, the amount of the toner existing in the neighborhood of the cleaning blade 61 increases and the toner and its external additive function as the lubricant, so that the frictional force between the cleaning blade 61 and the photosensitive drum 1 lowers. For that reason, even in the case where the blade pressure is relatively high, a phenomenon that the piece of the broken cleaning blade and the turning-up of the cleaning blade 61 are liable to generate relatively early after the formation of the toner band is suppressed.

From results of study on the above-described strain and the torque, it is understood that the following is true. That is, in the case where the blade pressure is relatively low, the torque of the driving motor for the photosensitive drum 1 is low, and therefore a time until the piece of the broken cleaning blade and the turning-up of the cleaning blade 61 are liable to generate is long. For that reason, in the case where the blade pressure is relatively low, the toner band density can be made sufficiently thin so that passing of the toner through the cleaning blade 61 can be suppressed. On the other hand, in the case where the blade pressure is relatively high, the torque of the driving motor for the photosensitive drum 1 is high, and therefore a time until the piece of the broken cleaning blade and the turning-up of the cleaning blade 61 are liable to generate is short. For that reason, in the case where the blade pressure is relatively low, the toner band density is required to be increased so that the toner and its external additive can exist in the neighborhood of the cleaning blade 61. Further, in the case where the blade pressure is relatively high, as described above, even when the toner band density is increased, the passing of the toner through the cleaning blade 61 does not readily generate.

Therefore, in this embodiment, on the basis of the information on the blade pressure, an amount of the toner, for frictional force adjustment, supplied to the contact portion between the photosensitive drum 1 and the cleaning blade 61 is changed by a supplying operation. Specifically, in this embodiment, the density of the toner band formed by the supplying operation is changed on the basis of the information on the blade pressure.

Table 1 below shows an example of a relationship between the blade pressure and the density setting value of the toner band in this embodiment. In this embodiment, information indicating this relationship is obtained in advance and is stored in a main assembly storing portion 81 (FIG. 5) as an information storing means provided in the apparatus main assembly 110. The main assembly storing portion 81 includes storing elements such as RAM and ROM, and the controller 30 can effect reading of the information from the main assembly storing portion 81 and writing of the information in the main assembly storing portion 81. Incidentally, Table 1 is an example, and values may also be set at more levels, and setting values between the respective blade pressures may also be obtained by interpolation (calculation).

TABLE 1

| Blade pressure (gf/cm) | Density setting value |
|---|---|
| 100 | 4 |
| 150 | 8 |
| 200 | 15 |

Figure 10:
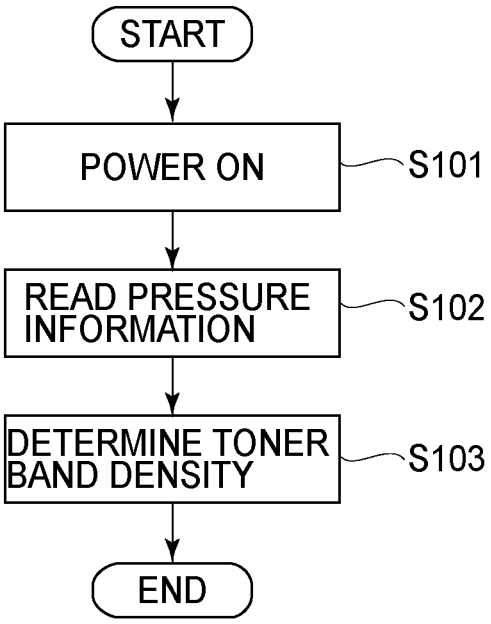
FIG. 10 is a flowchart showing a procedure of control for changing setting of an operation for forming the toner band.

FIG. 10 is a flowchart showing an outline of a procedure of control in this embodiment. When a power source of the image forming apparatus 100 is turned on (S101), the controller 30 reads the information on the blade pressure from the cartridge storing portion 50 (S102). Then, the controller 30 determines the toner band density for the drum cartridge 10 mounted in the apparatus main assembly 110 on the basis of the information indicating the relationship between the blade pressure and the density setting value stored in the main assembly storing portion 81 as shown in Table 1 (S103). The information on the determined toner band density is stored in the main assembly storing portion 81. Further, the controller 30 forms the toner band with the above-determined density when the supplying operation is performed at the predetermined timing as described above.

Thus, in this embodiment, the controller 30 changes the setting of the supplying operation on the basis of the information on the contact pressure of the cleaning blade 61 against the photosensitive drum 1. In this embodiment, the controller 30 changes, as the setting of the supplying operation, the toner amount of the predetermined toner image (toner band) which reaches the contact portion between the photosensitive drum 1 and the cleaning blade 61 in the supplying operation, on the basis of the information on the contact pressure. In this embodiment, the controller 30 makes the toner amount smaller in the case where the contact pressure is a second contact pressure smaller than a first contact pressure than in the case where the contact pressure is the first contact pressure. Particularly, in this embodiment, the controller 30 changes the toner amount by changing the toner band density. At this time, the controller 30 makes the toner band density so that the density in the case where the contact pressure is the second contact pressure smaller than the first contact pressure is smaller than the density in the case where the contact pressure is the first contact pressure.

As described above, according to this embodiment, an image forming condition of the toner band is changed depending on the blade pressure, and the toner for frictional force adjustment is adequately supplied to the contact portion between the photosensitive drum 1 and the cleaning blade 61, so that an attitude of the cleaning blade 61 can be stabilized. As a result, it is possible to suppress generation of image defect due to the passing of the toner of the toner band through the cleaning blade 61 while suppressing that the piece of the broken cleaning blade and the turning-up of the cleaning blade 61 are liable to generate.

Embodiment 2

Next, another embodiment of the present invention will be described. Basic constitutions and operations of an image forming apparatus in this embodiment are the same as those in Embodiment 1. Accordingly, in the image forming apparatus in this embodiment, elements having the same or corresponding functions and constitutions as those in the image forming apparatus in Embodiment 1 are represented by the same reference numerals or symbols and will be omitted from detailed description.

In Embodiment 1, the toner band density was changed depending on the information on the blade pressure. However, the strain (FIG. 8) and the torque (FIG. 9) described in Embodiment 1 are sensitive to the amount of the toner reaching the contact portion between the photosensitive drum 1 and the cleaning blade 61.

Figure 11:
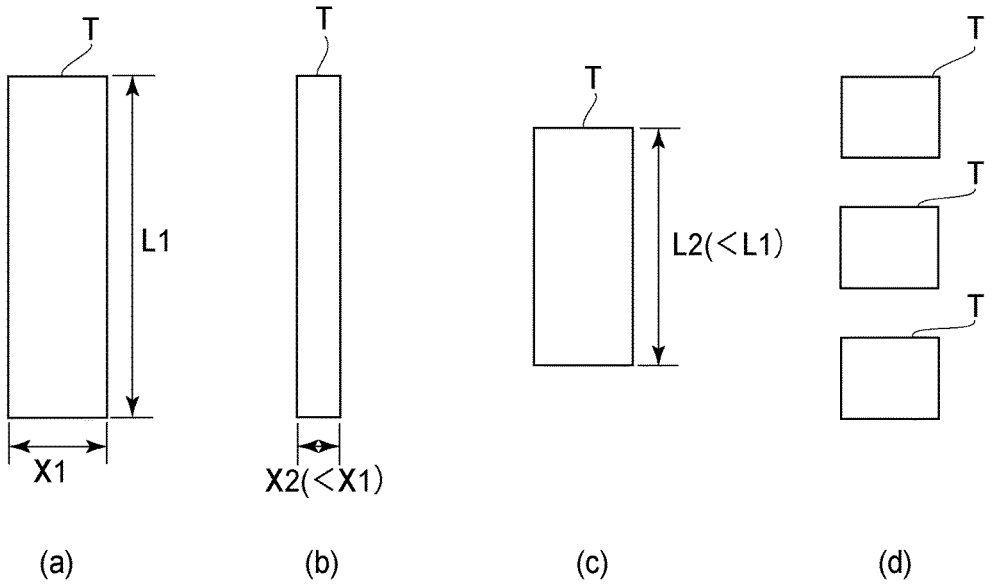
In FIGS. 11, (a) to (d) are schematic views each showing another example of a method of changing a toner amount of the toner band.

For that reason, as a method of changing the toner amount of the toner band, also by changing a size of the toner band, it is possible to obtain an effect similar to the effect of Embodiment 1. As regards the toner band size, lengths (X1, X2) of the toner band with respect to a circumferential direction of the photosensitive drum 1 may be changed as shown in (a) and (b) of FIG. 11, and lengths (L1, L2) of the toner band with respect to a longitudinal direction of the photosensitive drum 1 may also be changed as shown in (a) and (c) of FIG. 11. Further, the lengths of the toner band with respect to both of these directions may also be changed. Further, as shown in (d) of FIG. 11, the number of toner bands (patches) formed at the same time may also be changed. This is comparable to a change in the sum of the lengths of the toner bands with respect to the circumferential direction or the longitudinal direction of the photosensitive drum 1.

That is, in the case where the toner band size is relatively large (for example, the length with respect to the circumferential direction of the photosensitive drum 1 is relatively long), the load on the cleaning blade 61 increases, and when the blade pressure is relatively low, the passing of the toner through the cleaning blade 61 is liable to generate. However, when the blade pressure is relatively high, the toner amount in the neighborhood of the cleaning blade 61 increases, so that the time until the piece of the broken cleaning blade and the turning-up of the cleaning blade 61 are liable to generate can be prolonged. On the other hand, in the case where the toner band size is relatively small (for example, the length with respect to the circumferential direction of the photosensitive drum 1 is relatively short), the load on the cleaning blade 61 decreases, and therefore even when the blade pressure is relatively low, the passing of the toner through the cleaning blade 61 does not readily generate. However, when the blade pressure is relatively high, the toner amount in the neighborhood of the cleaning blade 61 decreases, so that the time until the piece of the broken cleaning blade and the turning-up of the cleaning blade 61 are liable to generate becomes short.

Thus, the controller 30 can change the toner amount of the toner band reaching the contact portion between the photosensitive drum 1 and the cleaning blade 61 in the supplying operation by changing the toner band size. At this time, the controller 30 makes the toner band size smaller in the case where the contact pressure is the second contact pressure smaller than the first contact pressure than in the case where the contact pressure is the first contact pressure.

Further, as a method of changing the toner amount of the toner band, it is also possible to change an electric field formed at the primary transfer portion N1 when the toner band passes through the primary transfer portion N1.

For example, in the case where the amount of the toner reaching the contact portion between the photosensitive drum 1 and the cleaning blade 61 is increased, a voltage of the same polarity as the normal charge polarity (opposite to the polarity during the primary transfer) is applied to the primary transfer roller 5 when the toner band passes through the primary transfer portion N1. As a result, transfer of the toner of the toner band onto the intermediary transfer belt 7 is suppressed. On the other hand, in the case where the amount of the toner reaching the contact portion between the photosensitive drum 1 and the cleaning blade 61 is decreased, a voltage of the opposite polarity to the normal charge polarity (the same polarity as the polarity during the primary transfer) is applied to the primary transfer roller 5 when the toner band passes through the primary transfer portion N1. As a result, at least a part of the toner of the toner band is transferred onto the intermediary transfer belt 7. Further, by changing a value of the voltage applied to the primary transfer roller 5, it is possible to adjust the toner amount of the toner band reaching the contact portion between the photosensitive drum 1 and the cleaning blade 61. That is, it is only required that a magnitude of the electric field for moving (urging) the toner of the toner band, formed at the primary transfer portion N1 when the toner band passes through the primary transfer portion N1, from the intermediary transfer belt 7 toward the photosensitive drum 1 be changed. As a result, it is possible to change the toner amount of the toner band transferred from the photosensitive drum 1 onto the intermediary transfer belt 7 (i.e., the toner amount of the toner band remaining on the photosensitive drum 1 without being transferred onto the intermediary transfer belt 7).

Thus, the controller 30 can change the toner amount of the toner band reaching the contact portion between the photosensitive drum 1 and the cleaning blade 61 in the supplying operation by changing the electric field formed at the primary transfer portion N1 when the toner band passes through the primary transfer portion N1. At this time, the controller 30 makes the magnitude of the electric field for urging the toner of the toner band formed at the primary transfer portion N1 toward the photosensitive drum 1 smaller in the case where the contact pressure is the second contact pressure smaller than the first contact pressure than in the case where the contact pressure is the first contact pressure. Typically, the controller 30 can set the polarity of the voltage applied to the primary transfer roller 5 so that the polarity is the same as the charge polarity of the toner of the toner band in the case where the contact pressure is the first contact pressure and is opposite to the charge polarity of the toner of the toner band in the case where the contact pressure is the second contact pressure smaller than the first contact pressure.

Incidentally, the toner of the toner band transferred on the intermediary transfer belt 7 is removed and collected from the surface of the intermediary transfer belt 7 by the belt cleaning device 74. When the toner band passes through the secondary transfer portion N2, in order to suppress deposition of the toner of the toner band on the secondary transfer roller 8, the voltage of the same polarity as the normal charge polarity of the toner (opposite to the polarity during the secondary transfer) may also be applied to the secondary transfer roller 8.

In this embodiment, in place of the information (Table 1) indicating the relationship between the blade pressure and the density setting value of the toner band in Embodiment 1, control is effected by the same procedure (FIG. 10) in Embodiment 1 by using information indicating a relationship between the blade pressure and the toner band size or the voltage applied to the primary transfer roller 5.

As described above, by changing the toner band size or the electric field formed at the primary transfer portion N1, even when the toner amount of the toner band is changed, an effect similar to that in Embodiment 1 can be obtained.

Incidentally, the toner amount of the toner band may also be changed by changing two or more of the toner band density, the toner band size and the electric field formed at the primary transfer portion N1.

Embodiment 3

Next, another embodiment of the present invention will be described. Basic constitutions and operations of an image forming apparatus in this embodiment are the same as those in Embodiment 1. Accordingly, in the image forming apparatus in this embodiment, elements having the same or corresponding functions and constitutions as those in the image forming apparatus in Embodiment 1 are represented by the same reference numerals or symbols and will be omitted from detailed description.

Figure 12:
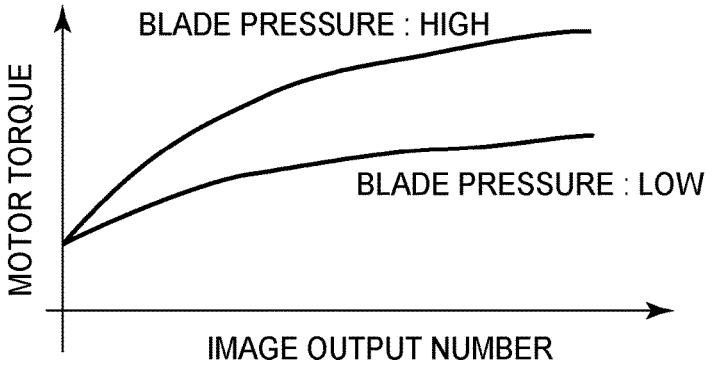
FIG. 12 is a graph showing a difference in driving torque of the photosensitive drum depending on blade pressure.

FIG. 12 shows a result of measurement of a torque of a driving motor for the photosensitive drum 1 when a predetermined toner band is formed by changing the blade pressure and thereafter solid white images are continuously formed in the image forming apparatus 100 having a constitution in this embodiment.

As shown in FIG. 12, when the blade pressure is changed, a torque increasing speed of the driving motor for the photosensitive drum 1 after the toner band is formed changes. In the case where the blade pressure is relatively high, the frictional force between the photosensitive drum 1 and the cleaning blade 61 is large and the torque increasing speed of the driving motor for the photosensitive drum 1 is high, and therefore the time until the piece of the broken cleaning blade and the turning-up of the cleaning blade 61 are liable to generate is short. On the other hand, in the case where the blade pressure is relatively low, the frictional force between the photosensitive drum 1 and the cleaning blade 61 is small and the torque increasing speed of the driving motor for the photosensitive drum 1 is low, and therefore the time until the piece of the broken cleaning blade and the turning-up of the cleaning blade 61 are liable to generate is long.

Therefore, in this embodiment, on the basis of the information on the blade pressure, timing when the supplying operation is executed is changed. Specifically, in this embodiment, an execution frequency (toner band formation frequency) of the supplying operation relative to an image output number is changed on the basis of the information on the blade pressure.

Figure 5:
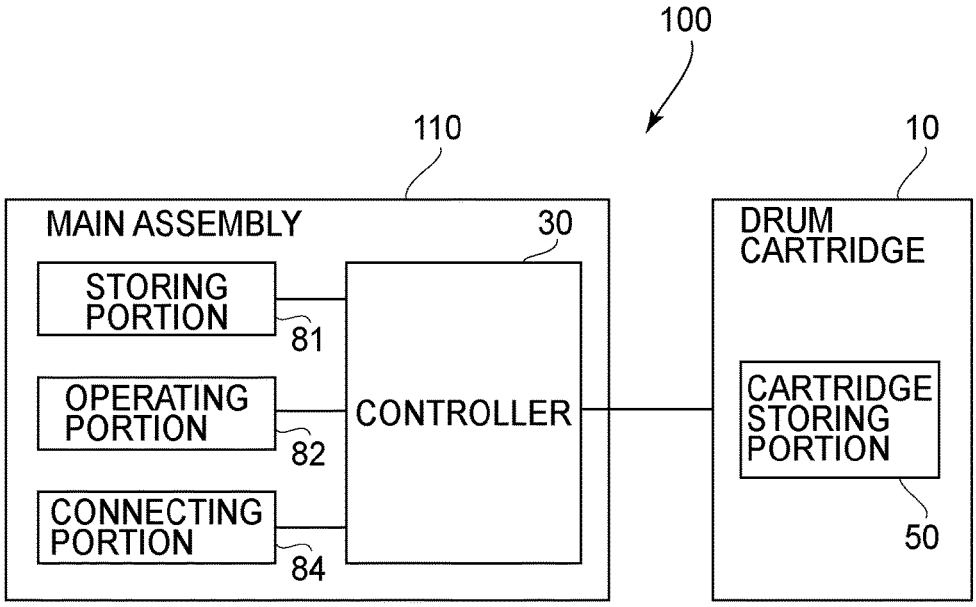
FIG. 5 is a block diagram showing a general control mode of the image forming apparatus.

Table 2 below shows an example of a relationship between the blade pressure and the execution frequency of the supplying operation in this embodiment. In this embodiment, the information indicating this relationship is obtained in advance and is stored in the main assembly storing portion 81 (FIG. 5). Incidentally, Table 2 is an example, and values thereof may also be set at more levels and setting values between the respective blade pressures may also be obtained by interpolation (calculation).

TABLE 2

| Blade pressure (gf/cm) | Execution frequency (sheets) |
|---|---|
| 100 | 50 |
| 150 | 70 |
| 200 | 100 |

In this embodiment, the controller 30 determines the execution frequency of the supplying operation (whether the supplying operation is executed for each output of what number of images) depending on the blade pressure read from the cartridge storing portion 50 by using the relationship as shown in Table 2 stored in the main assembly storing portion 81. The controller 30 stores the determined execution frequency of the supplying operation in the main assembly storing portion 81. Then, the controller 30 executes the supplying operation during non-image formation (e.g., during the sheet interval step or during the post-rotation step) at the determined frequency during the mounting of the drum cartridge 10 in the apparatus main assembly 110.

Thus, the controller 30 changes, as a setting value of the supplying operation, the execution frequency of the supplying operation relative to the image output number on the basis of the information on the blade pressure. At this time, the controller 30 makes the execution frequency lower in the case where the contact pressure is the second contact pressure lower than the first contact pressure than in the case where the contact pressure is the first contact pressure.

As described above, according to the present invention, by changing the toner band formation frequency, it is possible to suppress that the piece of the broken cleaning blade and the turning-up of the cleaning blade 61 are liable to generate while suppressing toner consumption to a minimum necessary amount.

Embodiment 4

Next, another embodiment of the present invention will be described. Basic constitutions and operations of an image forming apparatus in this embodiment are the same as those in Embodiment 1. Accordingly, in the image forming apparatus in this embodiment, elements having the same or corresponding functions and constitutions as those in the image forming apparatus in Embodiment 1 are represented by the same reference numerals or symbols and will be omitted from detailed description.

In the above-described embodiments, the information on the blade pressure was stored in the cartridge storing portion 50 and was used in the contact by the controller 30. However, the method of notifying the information on the blade pressure to the controller 30 is not limited thereto.

For example, when the drum cartridge 10 is mounted in the apparatus main assembly 110, the information on the blade pressure can be transferred from the cartridge storing portion 50 to the main assembly storing portion 81. That is, when the drum cartridge 10 is mounted in the apparatus main assembly 110, the information on the blade pressure stored in the cartridge storing portion 50 is inputted into the controller 30 of the apparatus main assembly 110. Then, the controller 30 stores the inputted information on the blade pressure in the main assembly storing portion 81. Then, the controller 30 reads the information on the blade pressure stored in the main assembly storing portion 81 and uses the information in the control during the mounting of the drum cartridge 10 in the apparatus main assembly 110.

Further, an operator such as a user or a service representative can input the information on the blade pressure from an operating portion 82 (FIG. 5) of the apparatus main assembly 110. The operating portion 82 has functions as an inputting means such as keys for inputting instructions into the controller 30 and as a displaying means such as a liquid crystal panel for displaying a state or the like of the image forming apparatus 100. That is, a provider of the drum cartridge 10 can present the information on the blade pressure through any means every individual cleaning blade 61 (drum cartridge 10) or every production lot of the cleaning blade 61 (drum cartridge 10). For example, the provider can present the information in the form of the drum cartridge itself, a package of the drum cartridge 10, an article distributed together with the drum cartridge 10 such as a manual, or on a web site of a provider of the image forming apparatus through a network. The operator inputs the information on the blade pressure into the controller 30 by an operation at the operating portion 82 of the apparatus main assembly 110. Then, the controller 30 stores the inputted information on the blade pressure in the main assembly storing portion 81. Then, the controller 30 reads the information on the blade pressure stored in the main assembly storing portion 81 and uses the information during the mounting of the drum cartridge 10 in the apparatus main assembly 110. Incidentally, the blade pressure information may also be inputted from an operating portion of an external device such as a personal computer communicatably connected with the apparatus main assembly 110.

Further, the information inputted from the operating portion 82 of the apparatus main assembly 110 is not required to be the information itself on the blade pressure. If the information can identify the information on the blade pressure for the drum cartridge 10 mounted in the apparatus main assembly 110, the information may also be, e.g., a lot number, an individual identification number, or the like of the drum cartridge 10. For example, the case where the apparatus main assembly 110 is connected with the network through a network connecting portion 84 (FIG. 5) as an inputting means will be described. In this case, for example, the information on the blade pressure is associated with the lot number (or the individual identification number) of the drum cartridge 10 and is stored in an external storing portion (not shown) in a service depot of the provider of the image forming apparatus 100. This external storing portion and the apparatus main assembly 110 are connected through the network. Then, the provider inputs the lot number, of the drum cartridge 10 mounted into the apparatus main assembly 110, from the operating portion 82 of the apparatus main assembly 110 into the controller 30. The lot number of the drum cartridge 10 can be presented in the form of the drum cartridge 10 itself, or the package of the drum cartridge 10 or the article, such as the manual, distributed together with the drum cartridge 10. Then, the controller 30 acquires the information on the blade pressure corresponding to the inputted lot number of the drum cartridge 10 from the external storing portion. Further, the controller 30 stores the acquired information on the blade pressure in the main assembly storing portion 81. Then, the controller 30 reads the information on the blade pressure stored in the main assembly storing portion 81 and uses the information in the control during the mounting of the drum cartridge 10 in the apparatus main assembly 110. Incidentally, the lot number may also be inputted from the operating portion of the external device such as the personal computer communicatably connected with the apparatus main assembly 110.

Incidentally, pieces of information on the toner band density for each blade pressure (Embodiment 1), the toner band size or the voltage applied to the primary transfer roller 5 (Embodiment 2), and the toner band formation frequency (Embodiment 3) may also be stored in the above-described storing portion. The controller 30 acquires these pieces of information from the external storing portion (and may also further store the pieces of information in the main assembly storing portion 81), and can use the pieces of information in the control. Further, the pieces of information on the toner band density for each blade pressure (Embodiment 1), the toner band size or the voltage applied to the primary transfer roller 5 (Embodiment 2), and the toner band formation frequency (Embodiment 3) may also be stored in the cartridge storing portion 50. Further, information on setting of the supplying operation determined depending on the blade pressure may also be stored in the external storing portion or the cartridge storing portion 50, as desired.

Other Embodiments

The present invention was described based on the specific embodiments mentioned above, but is not limited to the above-mentioned embodiments.

In the above-described embodiments, in the image forming apparatus, the drum cartridge integrally including the photosensitive member, the cleaning means and the charging means detachably mountable to the apparatus main assembly was used, but the present invention is not limited thereto. For example, the photosensitive member, and as the process means actable on the photosensitive member, the charging means, the developing means and the cleaning means may also be integrally assembled into a process cartridge detachably mountable to the apparatus main assembly. Further, the information is not required to be of a cartridge mounting and demounting type. The cleaning members may also be individually exchangeable.

Further, in the above-described embodiments, the case where the blade pressure was different depending on the manufacturing variation was described as an example, but the present invention is not limited thereto. For example, the present invention is applicable even in the case where the setting of the blade pressure is intentionally changed due to an arbitrary reason such as a change in setting due to a difference in type (model) of the image forming apparatus, a change in setting due to a use (operation) environment or use status of the image forming apparatus by the user, or the like.

Further, in the above-described embodiments, the cleaning member for the photosensitive member was described, but the present invention may also be applied to the cleaning member for the intermediary transfer member. When description is made in accordance with the image forming apparatus 100 in FIG. 1, in this case, in the supplying operation, the toner band is formed at a single or any of a plurality of image forming portions S and is transferred onto the intermediary transfer belt 7. This toner band is fed to the contact portion between the cleaning blade 74*a* of the cleaning device 74 and the intermediary transfer belt 7. The cleaning blade 74*a* is pressed (urged) against the intermediary transfer belt 7 toward the tension roller 73 and is contacted to the surface of the intermediary transfer belt 7. Further, similarly as in the above-described embodiments, on the basis of the information on the contact pressure of the cleaning blade 74*a* against the intermediary transfer belt 7, the toner band density, the toner band size, the voltage applied to the primary transfer roller 5, or the toner band formation frequency is changed. Incidentally, in the case where the toner amount of the toner band is adjusted by changing the electric field formed at the primary transfer portion N1, a relationship among a toner amount increasing and decreasing method and a direction and strength of the formed electric field may only be required to be reversed. That is, in the case where the toner amount of the toner band is increased, the magnitude of the electric field, for moving (urging) the toner of the toner band from the photosensitive drum 1 toward the intermediary transfer belt 7, formed at the primary transfer portion N1 when the toner band passes through the primary transfer portion N1 may only be required to be increased. In the case where the toner amount of the toner band is decreased, the magnitude of the electric field may only be required to be decreased (reversed). Thus, an object to be cleaned by the cleaning member need not only be the image bearing member for bearing the toner image, but may also be an electrostatic recording dielectric member.

Further, the present invention can also be applied to a cleaning member for a single photosensitive member in an image forming apparatus including only the single photosensitive member as the image bearing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-022171 filed on Feb. 8, 2016, which is hereby incorporated by reference herein in its entirety.

What is claimed is:

1. An image forming apparatus comprising:

an image bearing member configured to bear a toner image;

a transfer member configured to transfer the toner image from said image bearing member onto a toner image receiving member at a transfer portion;

a cleaning member contacting said image bearing member at a contact portion and configured to remove transfer residual toner remaining on a surface of said image bearing member from the surface of said image bearing member with movement of said image bearing member; and an executing portion configured to execute a supplying operation for forming a predetermined toner image on said image bearing member during non-image formation and then supplying toner of the predetermined toner image to the contact portion, wherein said executing portion executes the supplying operation with a forming condition of the predetermined toner image preset on the basis of information on contact pressure applied by said cleaning member to said image bearing member.

2. An image forming apparatus according to claim 1, wherein said executing portion executes the supplying operation with a toner amount, of the predetermined toner image reaching the contact portion in the supplying operation, changed on the basis of the information on the contact pressure.

3. An image forming apparatus according to claim 2, wherein said executing portion executes the supplying operation so that the toner amount when the contact pressure is a second contact pressure smaller than a first contact pressure is less than the toner amount when the contact pressure is the first contact pressure.

4. An image forming apparatus according to claim 2, wherein said executing portion executes the supplying operation with the toner amount changed by changing a density of the predetermined toner image.

5. An image forming apparatus according to claim 4, wherein said executing portion executes the supplying operation so that the density when the contact pressure is a second contact pressure smaller than a first contact pressure is smaller than the density when the contact pressure is the first contact pressure.

6. An image forming apparatus according to claim 2, wherein said executing portion executes the supplying operation with the toner amount changed by changing a size of the predetermined toner image.

7. An image forming apparatus according to claim 6, wherein said executing portion executes the supplying operation so that the size when the contact pressure is a second contact pressure smaller than a first contact pressure is less than the size when the contact pressure is the first contact pressure.

8. An image forming apparatus according to claim 2, wherein said executing portion executes the supplying operation with the toner amount changed by changing an electric field formed at the transfer portion by said transfer member when the predetermined toner image passes through the transfer portion.

9. An image forming apparatus according to claim 8, wherein said executing portion executes the supplying operation so that a magnitude of the electric field in a direction in which the toner moves toward said image bearing member when the predetermined toner image passes through the transfer portion is smaller when the contact pressure is a first contact pressure than when the contact pressure is a second contact pressure smaller than the first contact pressure.

10. An image forming apparatus according to claim 8, wherein said executing portion executes the supplying operation so that a polarity of a voltage applied to said transfer means when the predetermined toner image passes through the transfer portion is the same polarity as a charge polarity of the toner of the predetermined toner image when the contact pressure is a first contact pressure and so that the polarity of the voltage is an opposite polarity to the charge polarity of the toner of the predetermined toner image when the contact pressure is a second contact pressure smaller than the first contact pressure.

11. An image forming apparatus according to claim 1, wherein said executing portion executes the supplying operation so that an execution frequency thereof with respect to an image output number is changed on the basis of the information on the contact pressure.

12. An image forming apparatus according to claim 11, wherein said executing portion executes the supplying operation so that the execution frequency is lower when the contact pressure is a second contact pressure smaller than a first contact pressure than when the contact pressure is the first contact pressure.

13. An image forming apparatus according to claim 1, wherein a cartridge including said cleaning member is detachably mountable to a main assembly of said image forming apparatus, and wherein the information on the contact pressure is stored in a storing portion provided in the cartridge.

14. An image forming apparatus according to claim 13, wherein when the cartridge is mounted in the main assembly, said executing portion stores the information on the contact pressure stored in the storing portion of the cartridge in a storing portion provided in the main assembly of said image forming apparatus and executes the supplying operation.

15. An image forming apparatus according to claim 13, wherein the cartridge further includes said image bearing member.

16. An image forming apparatus according to claim 1, further comprising an input portion configured to input the information on the contact pressure to said executing portion, wherein said executing portion stores the information on the inputted contact pressure in a storing portion provided in the main assembly of said image forming apparatus and executes the supplying operation.

17. An image forming apparatus according to claim 16, wherein said input portion is an operating portion operated by an operator.

18. An image forming apparatus according to claim 16, wherein said input portion is a connecting portion configured to communicatably connect said executing portion and an external storing portion in which the information on the contact pressure is stored.

19. An image forming apparatus according to claim 1, wherein said image bearing member is a photosensitive drum.

* * * * *